US010704257B1

(12) United States Patent
Moran

(10) Patent No.: US 10,704,257 B1
(45) Date of Patent: Jul. 7, 2020

(54) FOAM BLOCK AND POURED CONCRETE WALL SYSTEM

(71) Applicant: James Moran, Stanley, WI (US)

(72) Inventor: James Moran, Stanley, WI (US)

( * ) Notice: Subject to any disclaimer, the term of this patent is extended or adjusted under 35 U.S.C. 154(b) by 0 days.

(21) Appl. No.: 16/436,971

(22) Filed: Jun. 11, 2019

Related U.S. Application Data

(60) Provisional application No. 62/792,550, filed on Jan. 15, 2019.

(51) Int. Cl.
*E04B 2/28* (2006.01)
*E04C 1/41* (2006.01)

(52) U.S. Cl.
CPC . *E04B 2/28* (2013.01); *E04C 1/41* (2013.01)

(58) Field of Classification Search
CPC ..... E04B 2/28; E04B 2/8629; E04B 2/8652; E04C 1/41
USPC ... 52/220.2, 220.1, 220.3, 79.7, 79.9, 287.1, 52/288.1, 309.11, 309.12, 309.13, 309.7, 52/424, 426, 525
See application file for complete search history.

(56) References Cited

U.S. PATENT DOCUMENTS 4,884,382 A * 12/1989 Horobin ..... E04B 2/8641 52/426
4,924,641 A * 5/1990 Gibbar, Jr. ..... E04B 2/8652 52/204.1
4,967,528 A * 11/1990 Doran ..... E04B 2/8647 52/309.12
5,024,035 A 6/1991 Hanson et al.
5,524,400 A * 6/1996 Schmechel ..... E04B 1/14 52/236.7
6,178,711 B1 * 1/2001 Laird ..... E04B 2/8635 52/357
6,318,040 B1 * 11/2001 Moore, Jr. ..... E04B 2/8617 52/379
6,848,228 B1 2/2005 Williams
8,931,220 B2 * 1/2015 Stewart ..... E06B 1/02 249/39
2002/0023401 A1 * 2/2002 Budge ..... E04B 2/60 52/426
2002/0178676 A1 * 12/2002 Yost ..... E04B 2/8635 52/426
2003/0033781 A1 * 2/2003 Schmidt ..... E04B 2/8617 52/426
2005/0252134 A1 * 11/2005 Makovich ..... E04C 1/40 52/503

(Continued)

*Primary Examiner* — Theodore V Adamos
(74) *Attorney, Agent, or Firm* — Donald J. Ersler

(57) ABSTRACT

A foam block and poured concrete building system preferably includes a plurality of wall foam blocks, a plurality of corner foam blocks, poured concrete, a plurality of fastening strips and a plurality of fasteners. Two end cavities are formed in opposing ends of the plurality of wall foam blocks. Top and bottom cavities are formed in the plurality of wall foam blocks. Each corner foam block includes an inner angle plate, three middle spacers and an outer angle plate. Each fastening strip includes a plurality of holes formed at heights that correspond to a height of the plurality of wall foam blocks and the plurality of corner foam blocks. Window frames and doorframes include a plurality of fastening strips. When the plurality of wall and corner foam blocks are assembled to each other with the plurality of fastening strips and fasteners, concrete is poured into vertical cavities therein.

15 Claims, 9 Drawing Sheets

(56) References Cited

U.S. PATENT DOCUMENTS

| | | | | |
|---|---|---|---|---|
| 2006/0117689 | A1* | 6/2006 | Onken | E04C 2/22 52/309.7 |
| 2006/0179756 | A1* | 8/2006 | McGregor | E04G 17/042 52/426 |
| 2008/0066408 | A1* | 3/2008 | Hileman | E04B 2/8629 52/414 |
| 2008/0104906 | A1* | 5/2008 | Pyo | E04C 1/397 52/223.7 |
| 2008/0104912 | A1* | 5/2008 | Au | E04B 2/8629 52/309.8 |
| 2008/0120929 | A1* | 5/2008 | Keith | E06B 1/003 52/204.1 |
| 2008/0307736 | A1* | 12/2008 | Trimmer | E04G 17/047 52/426 |
| 2014/0123583 | A1 | 5/2014 | Arriola Serrano | |
| 2014/0130432 | A1* | 5/2014 | Stewart | E06B 1/02 52/215 |
| 2014/0150361 | A1* | 6/2014 | Castonguay | E04B 2/26 52/309.4 |
| 2018/0119418 | A1* | 5/2018 | Breaz | E04B 2/16 |

* cited by examiner

FOAM BLOCK AND POURED CONCRETE WALL SYSTEM

CROSS-REFERENCES TO RELATED APPLICATIONS

This is a non-provisional application taking priority from provisional application no. 62/792,550 filed on Jan. 15, 2019.

BACKGROUND OF THE INVENTION

Field of the Invention

The present invention relates generally to buildings and more specifically to a foam block and poured concrete building system, which reduces the cost and labor skill requirements for constructing the walls of a building.

Discussion of the Prior Art

U.S. Pat. No. 5,024,035 to Hanson et al. discloses a building block and structures formed therefrom. U.S. Pat. No. 6,848,228 to Williams discloses a method and apparatus for making foam blocks and for building structures therewith. Patent publication no. 2014/0123583 to Arriola Serrano discloses a block for construction and method of construction with said block.

In the construction industry, houses are normally built out of 2" x 4" or 2" x 6" lumber, which is used as the structural members of the walls of a house and are then sheathed in particle board or plywood (which is referred to as a "stick framed house"). The construction materials are cheap, but the labor that is used to construct them is expensive, and time-consuming. In addition, there is currently a shortage of skilled labor that knows how to build a conventional stick framed house. Furthermore, there is a lack of interested young workers willing to do this type of work, which will only further exacerbate the labor shortage and continue to drive up labor costs.

There has been a substitute to the conventional stick-framed house, which uses insulated concrete foam blocks (hereafter, I.C.F.'s). There are many different types, but the majority of these systems are made out of some form of Styrofoam that have voids in the centers, which once assembled are filled with concrete. The concrete acts as the structural members of the walls, and the Styrofoam acts as the insulation. Most of these systems are used in subterranean (below grade) as basements. The reason for this is that it is difficult to alter the size and shape of these "blocks" to account for "obstructions" in the wall, i.e. doors and windows. Therefore, most of these systems are not cost-effective to use above grade, and are relegated to be used for basements.

There is a better way and a much better design to accomplish using I.C.F.'s to build the entire house that is much more cost effective then building convention-ally built stick-framed houses. The insulated concrete foam blocks could be made where the house will be constructed. A mobile block making form would be on a trailer that is towed to the job site, and set up to start making blocks that pertain to a set of blue prints for the specific house to be constructed. The foam-block making machine will be totally self-contained with its' own generator to make its' own power, and to supply additional power to be used at the job site. It will have tanks that will contain the chemicals to be used to make the spray-in foam that will be made into the insulated concrete foam blocks.

The foam block machine would be capable of making enough I.C.F.'s to construct an entire house (3,600 s.f.}, in approximately 4 hours of actual running time. The advantages of manufacturing the blocks on site are: 1. To negate the shipping/transport costs to move them from a factory (that would normally produce them) to the construction site. 2. The blocks would be made specific for the house that is being constructed on the site. 3. The blocks are erected in a running bond that are bolted together with a 1" x 4" piece of P.V.C. that is pre-drilled for the bolts to go through, and simply be locked together using two nuts every 24 inches. 4 . All the doors and windows would be pre-hung and would be ready to install as the house is being assembled out of the I.C.F.'s. The pre-hung doors and windows would simply be bolted into place as the I.C.F.'s are erected. 5 . Once, the I.C.F.'s are placed with all of the doors and windows installed, concrete will be pumped into the cavities voids in the I.C.F.'s. Once the concrete cures, a truss system would be brought in; placed; sheathed; and installed and the roofing material on the truss system. A five man crew could make and place the blocks for an entire house in the course of one to two days. This would be a huge advantage over a conventional stick framed house that would easily take ten times longer to build. In addition, the people building a stick framed house are considerably more skilled, and as such, will demand a much higher wage, than the people who would assemble an I.C.F. built house.

The materials used to build an I.C.F. house would cost more, but those costs would easily be offset by the efficiency of building the I.C.F. house and the cost advantage in the pay of the individuals used to assemble it. In addition, the construction industry is experiencing a vast shortage of skilled carpenters that can build stick framed houses, as many of them are simply retiring. There is also a shortage of young workers to train to take their places. In the future, the I.C.F. building system would alleviate many of those problems, as a person could be trained to assemble this I.C.F. house in a matter of hours. As opposed to a carpenter who is skilled at building a stick framed house, which conservatively would take a minimum of two years of experience/training.

Likewise, the pay of a skilled carpenter who can build a stick framed house would likely be double that of a worker hired to assemble an I.C.F. house. An I.C.F. house could be built using a five person crew, a lead person, and four additional workers. The lead man would make $30.00 per hour and the additional workers would make $20.00 per hour. This would be a weekly pay rate of $4,400.00 per week for the crew. Conservatively, this crew could assemble two houses per week. ($4,400I 2=$2,200.00 per house.) After the walls have been assembled, a concrete pumping truck would come in and the cavities in the I.C.F.'s would be filled with concrete. After a couple of days the concrete would be cured. Thereafter, trusses would be craned into position on top of the walls, sheathed and roofed. Thereby, weather-proofing the house to have all of the interior details worked on. The interior walls could then be erected. The exterior walls are already insulated, at 12 inches thick, would yield a minimum R-50+. In contrast, a stick framed house would require a crew of 8 men working for about two-three weeks. Most of these men would average making in excess of $35.00 per hour. (This would require $11,200.00 per week in salary, and $11,200 x 2 or 3 weeks =$22,400-$33,600 in salary to build one house.) The interior walls could then be erected. Thereafter, trusses would be craned into position on top of the walls, sheathed and roofed. Thereby, weather-proofing the house to have all of the interior details worked on. The exterior walls would then have to be insulated with fiberglass insulation or with spray in foam insulation. The most that could be spayed into a 2" x 4" stud bay would 3.5 " (at R-6 per inch) this would result in an R-21 insulated wall. (2" x 6" stud walls are 5.5", and would yield an R-33 insulated wall.)

Accordingly, there is a clearly felt need in the art for a foam block and poured concrete building system, which includes a plurality of foam blocks, poured concrete and fastening strips for creating walls of a building.

SUMMARY OF THE INVENTION

The present invention provides a foam block and poured concrete building system, which reduces the cost and labor skill requirements for constructing the walls of a building. The foam block and poured concrete building system (foam and concrete building system) preferably includes a plurality of wall foam blocks, a plurality of corner foam blocks, poured concrete, a plurality of fastening strips and a plurality of fasteners. Each wall foam block may be molded as a single unit or assembled from multiple elements. The wall foam block includes a front plate, a rear plate, a first middle spacer and a second middle spacer. The front and rear plates include a middle slot and two end slots formed in an outer surface thereof. A width of the two end slots is preferably equal to a width of the middle slot. A middle cavity is located between one end of the first and second middle spacers. Two end cavities are located on opposing ends of the first and second middle spacers. A width of the two end cavities is preferably equal to a width of the middle cavity. Top and bottom cavities are formed above the first and second middle spacers. If the foam block is created from multiple elements, opposing faces of the first and second middle spacers are bonded to inside surfaces of the front and rear plates.

Each corner foam block includes an inner angle plate, three middle spacers and an outer angle plate. The inner angle plate includes a first end slot, a corner slot, a middle slot and a second end slot. The outer angle plate includes a first end slot, a corner slot, a middle slot and a second end slot. A width of the two end slots is preferably equal to a width of the middle slot. The three middle spacers are located between the inner and outer angle plates to create a first end cavity, a corner cavity, a middle cavity, a second end cavity, a top cavity and a bottom cavity.

Each fastening strip includes a plurality of holes formed at heights that correspond to a height of the plurality of wall foam blocks and the plurality of corner foam blocks. A plurality of holes are preferably formed through the plurality of wall and corner foam blocks to receive the plurality of fasteners inserted through the plurality of holes in the fastening strip. A window frame includes a window and a plurality of fastening strips extending from a top, bottom and opposing sides of the window frame. The plurality of fastening strips would be sized to receive the plurality of wall foam blocks. A door frame includes a door and a plurality of fastening strips extending from a top and opposing sides of the door frame. The plurality of fastening strips would be sized to receive the plurality of wall foam blocks. When the plurality of wall and corner foam blocks; window frames and door frame(s) are assembled to each other with the plurality of fastening strips and fasteners; concrete is poured into vertical cavities in the plurality of wall and corner form blocks. The poured concrete forms a grid work structure inside the plurality of middle cavities, end cavities, top cavities and bottom cavities in the plurality of wall and corner foam blocks.

Accordingly, it is an object of the present invention to provide a foam and concrete building system, which includes a plurality of foam blocks, poured concrete and fastening strips for creating the walls of a building.

Finally, it is another objection of the present invention to provide a foam and concrete building system, which reduces the cost and labor skill requirements for constructing the walls of a building.

These and additional objects, advantages, features and benefits of the present invention will become apparent from the following specification.

DETAILED DESCRIPTION OF THE PREFERRED EMBODIMENTS

Figure 8:
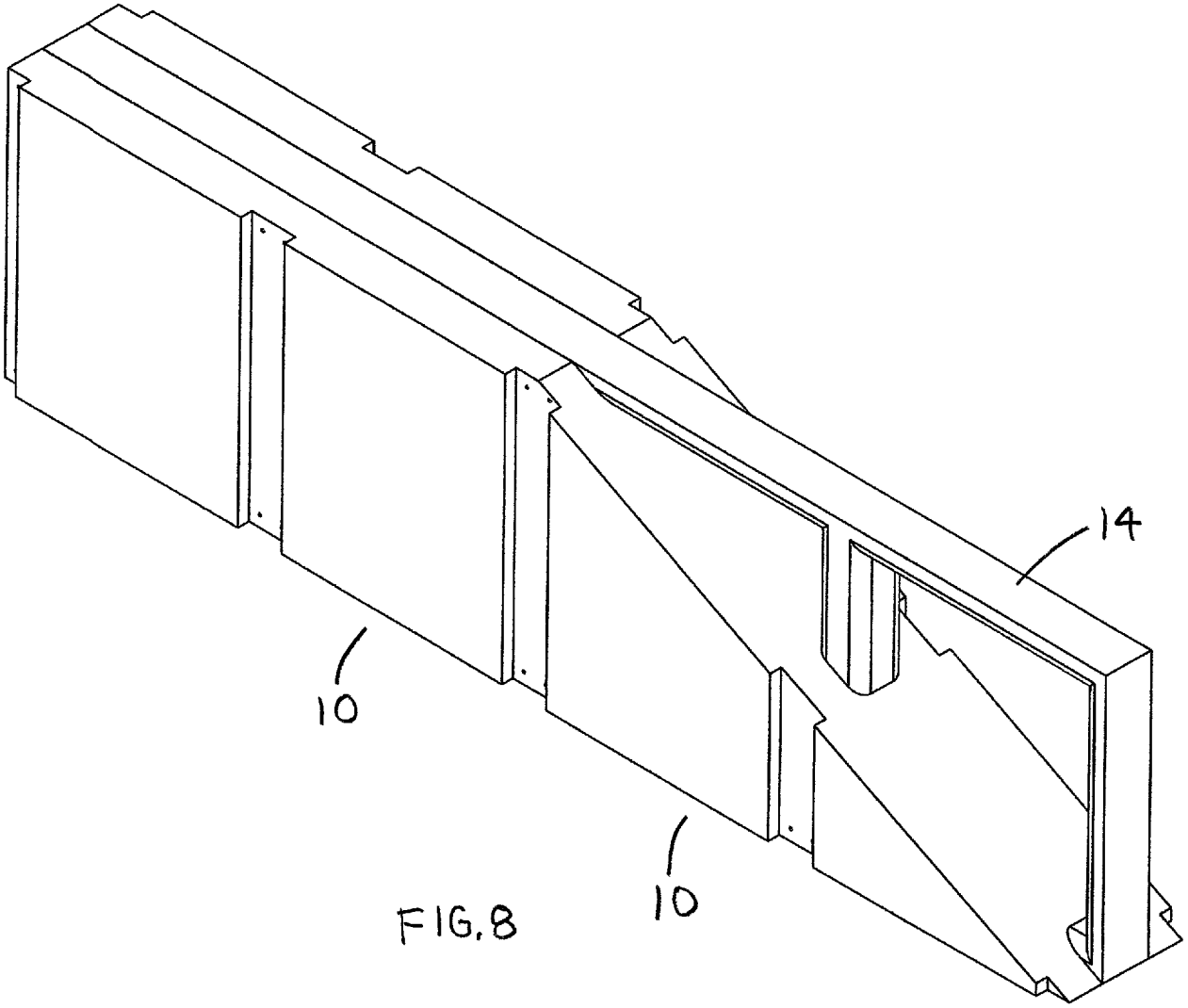
FIG. 8 is a perspective view of two wall foam blocks with a cut away of a portion of one of the two wall foam blocks, illustrating poured concrete of a foam and concrete building system in accordance with the present invention.
Figure 9:
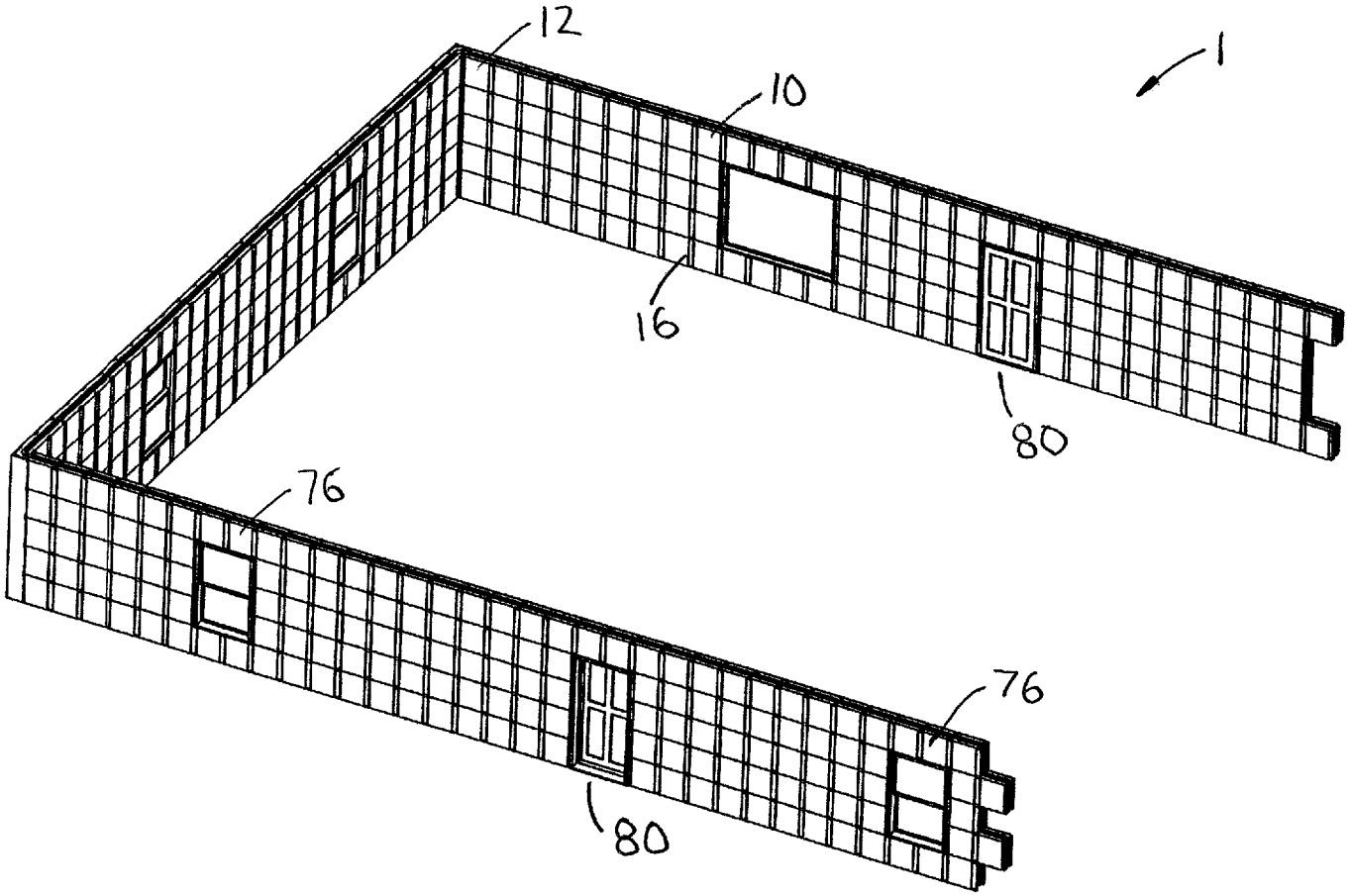
FIG. 9 is a perspective view of three walls of a building constructed from foam and concrete building system in accordance with the present invention.

With reference now to the drawings, and particularly to FIG. 9, there is shown a perspective view of a foam concrete building system 1. With reference to FIGS. 1 - 8, the foam and concrete building system preferably includes a plurality of wall foam blocks 10, a plurality of corner foam blocks 12, poured concrete 14, a plurality of fastening strips 16 and a plurality of fasteners 18. Each wall foam block 10 may be molded as a single unit or assembled from multiple elements. The wall foam block 10 includes a front plate 20, a rear plate 22, a first middle spacer 24 and a second middle spacer 26. The wall foam block 10' includes a front plate 20', a rear plate 22', a first middle spacer 24' and a second middle spacer 26'. The front and rear plates 20, 20', 22, 22' include a middle slot 28, 28' and two end slots 30, 30' formed in an outer surface thereof. A width of the two end slots 30, 30' is preferably equal to a width of the middle slot 28, 28'. A middle cavity 32, 32' is located between one end of the first and second middle spacers 24, 26, 24', 26'. Two end cavities 34, 34' are located on opposing ends of the first and second middle spacers 24, 26, 24', 26'. A width of the two end cavities 34, 34' is preferably equal to a width of the middle cavity 32, 32'. Top and bottom cavities 36, 38 are formed above the first and second middle spacers 24, 26. Opposing faces of the first and second middle spacers 24', 26' are bonded to inside surfaces of the front and rear plates 20, 22' of the wall foam block 10'. The following dimensions are given by way of example and not by way of limitation, the wall foam block 10, 10' has a preferable dimension of 24 inches long, 12 inches deep and 24 inches high, but other dimensions could also be used.

Figure 7:
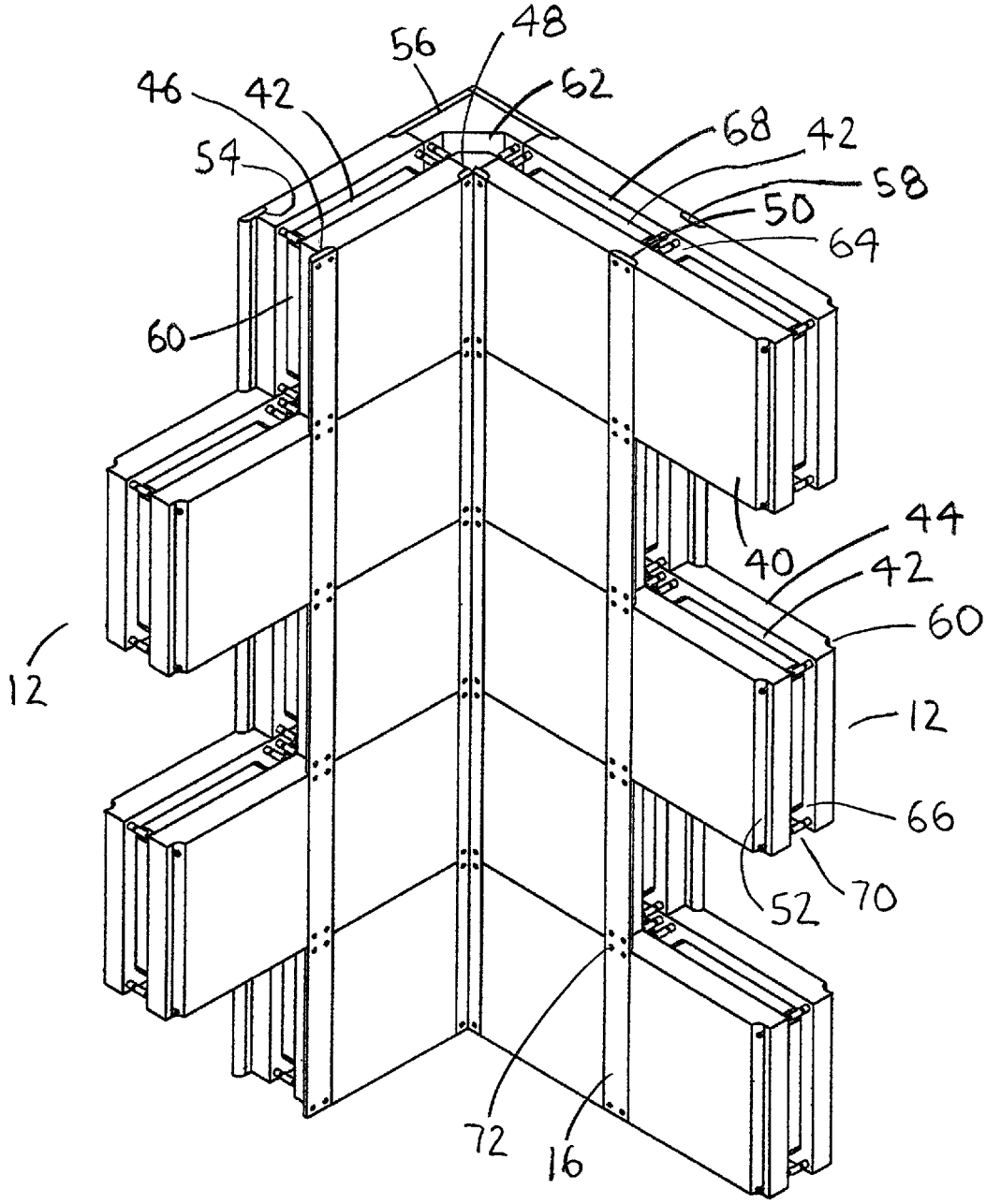
FIG. 7 is a perspective view of a plurality of corner foam blocks assembled to each other with a plurality of fastening strips of a foam and concrete building system in accordance with the present invention.

With reference to FIG. 7, each corner foam block 12 includes an inner angle plate 40, three middle spacers 42 and an outer angle plate 44. The inner angle plate 40 includes a first end slot 46, a corner slot 48, a middle slot 50 and a second end slot 52. The outer angle plate 44 includes a first end slot 54, a corner slot 56, a middle slot 58 and a second end slot 60. A width of the two end slots 46, 52, 54, 60 are equal to a width of the middle slot 50, 58. The three middle spacers 42 are located between the inner and outer angle plates 40, 44 to create a first end cavity 60, a corner cavity 62, a middle cavity 64, a second end cavity 66, a top cavity 68 and a bottom cavity 70.

Figure 1:
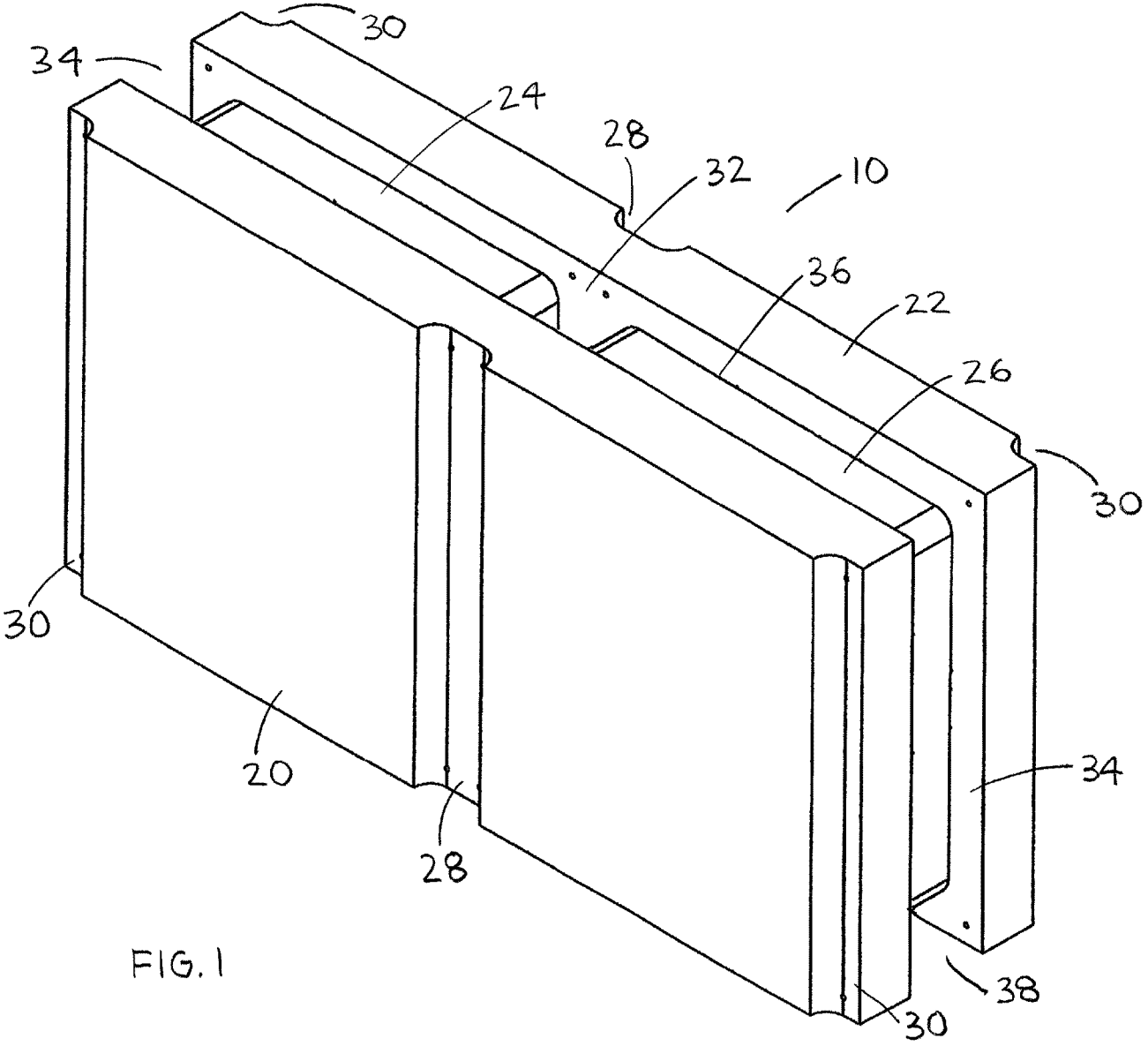
FIG. 1 is a perspective view of a wall foam block of a foam and concrete building system in accordance with the present invention.
Figure 2:
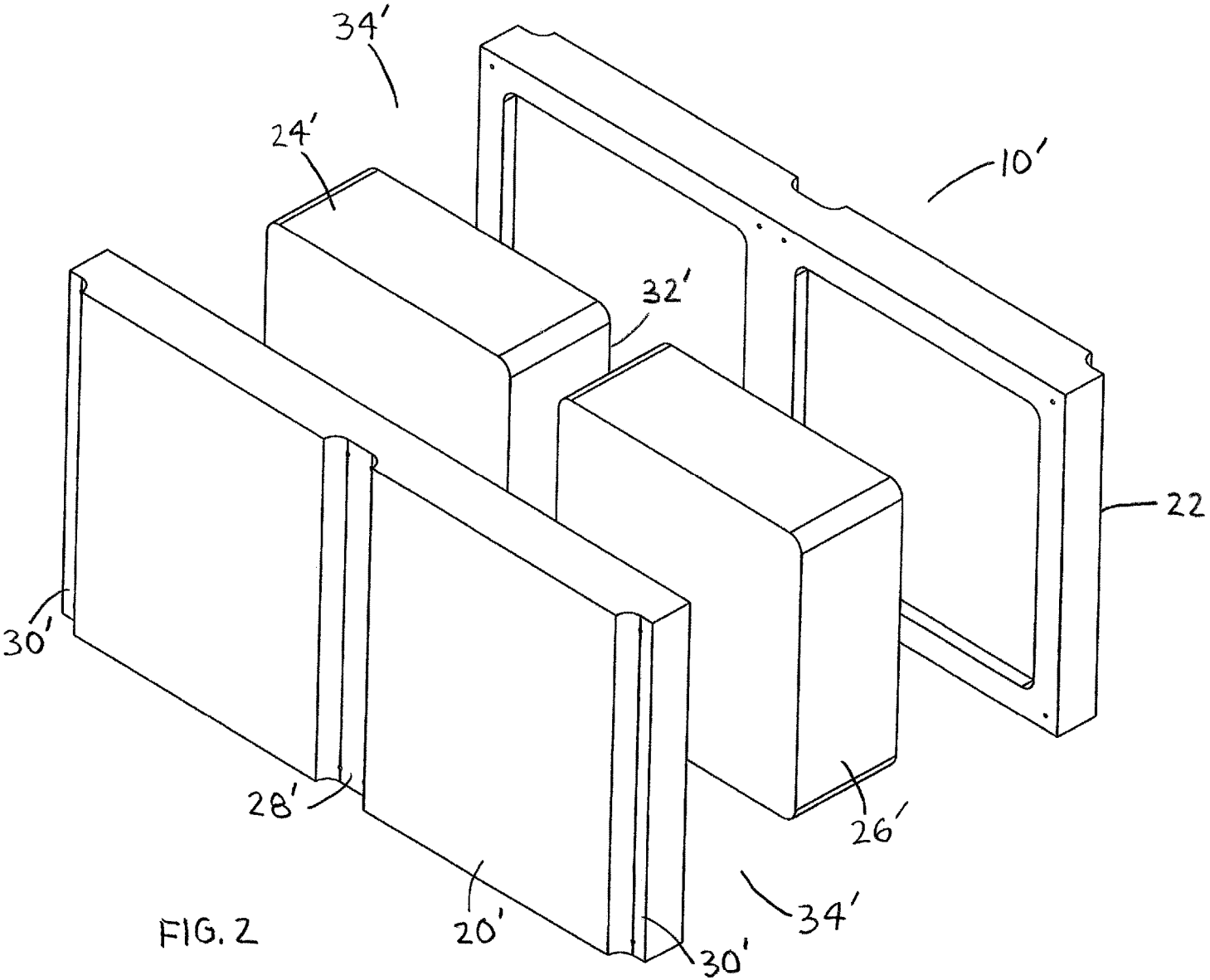
FIG. 2 is an exploded perspective view of a wall foam block of a foam and concrete building system in accordance with the present invention.
Figure 3:
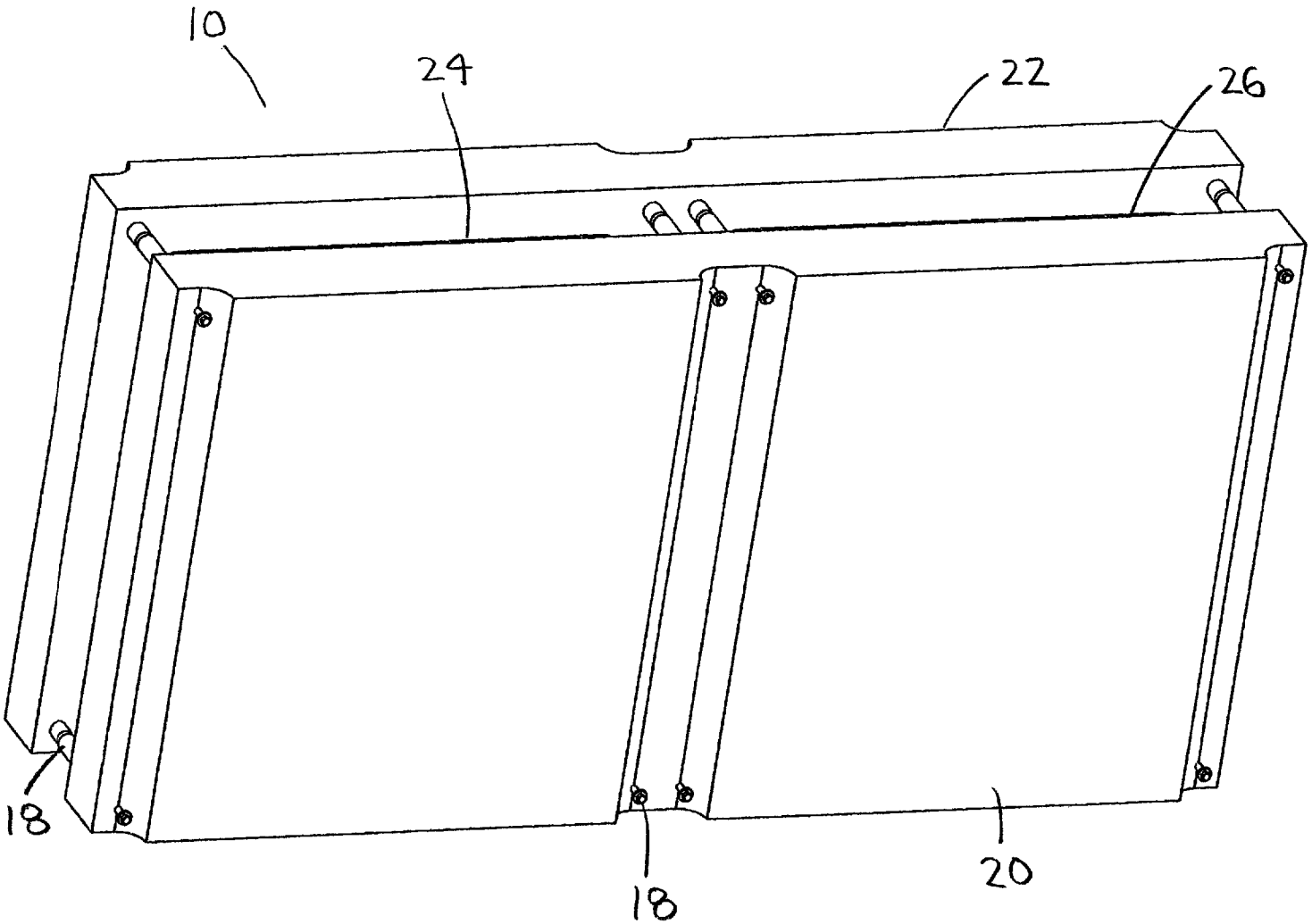
FIG. 3 is a perspective view of a wall foam block with a plurality of fasteners retained therein of a foam and concrete building system in accordance with the present invention.
Figure 4:
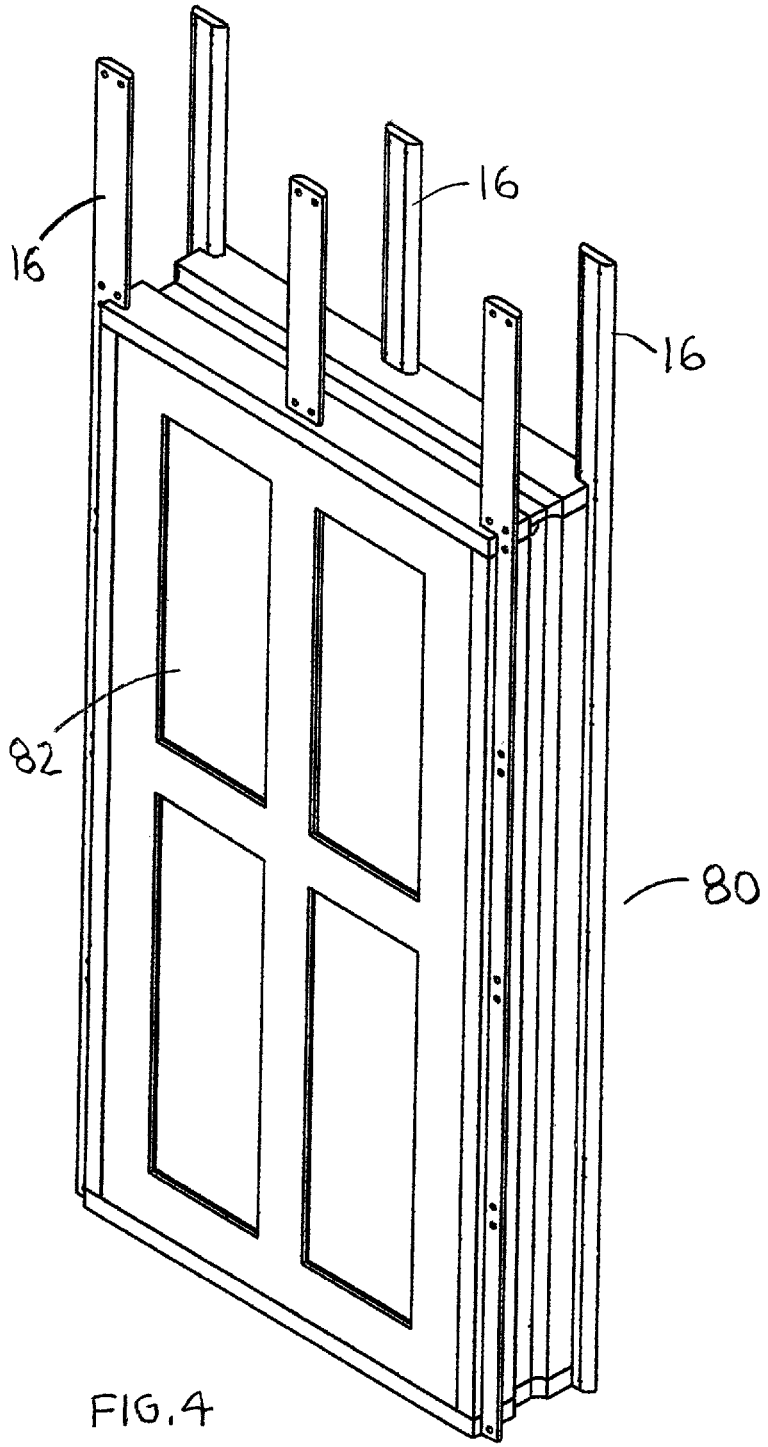
FIG. 4 is a perspective view of a door frame with a plurality of fastening strips extending therefrom of a foam and concrete building system in accordance with the present invention.
Figure 5:
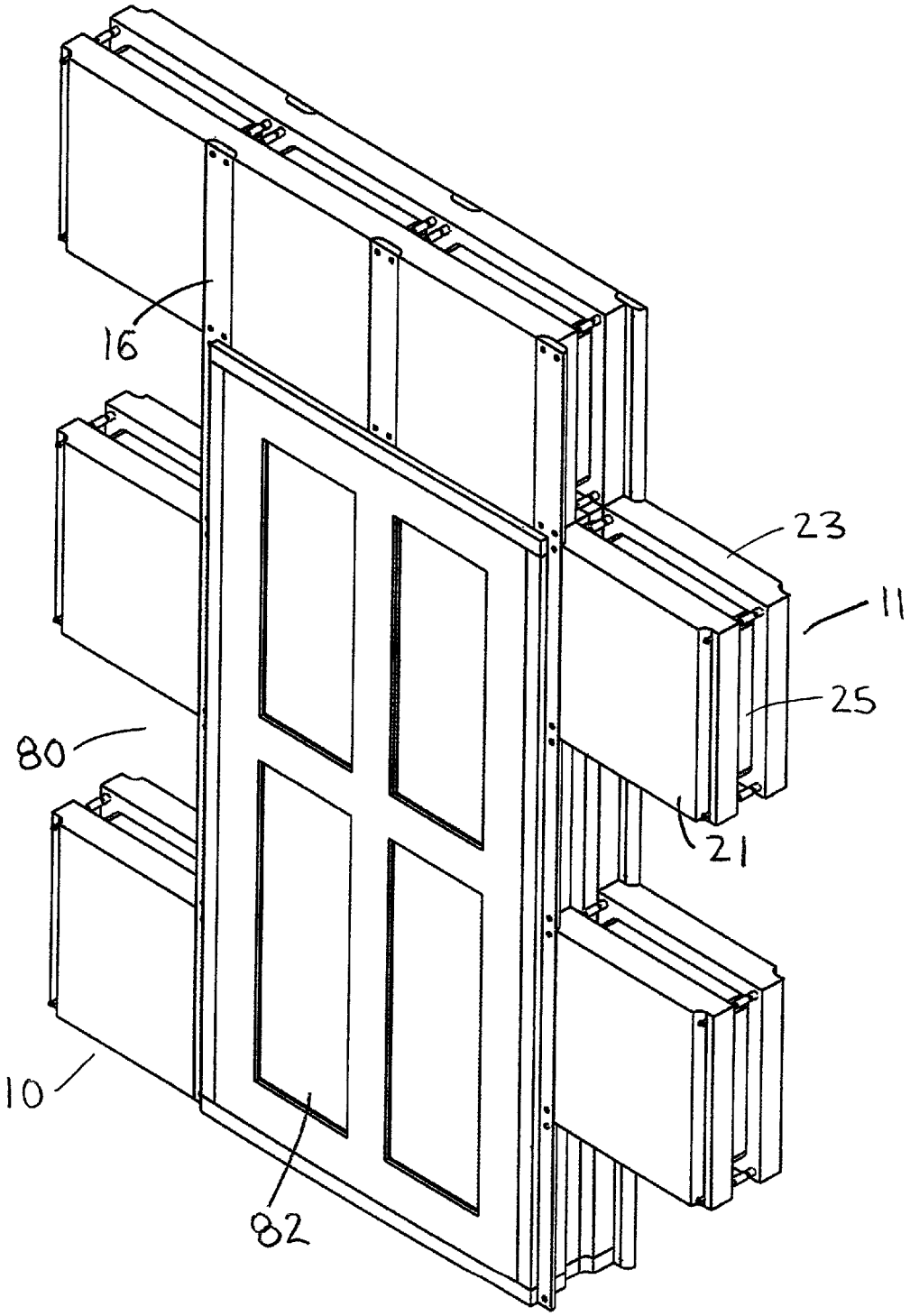
FIG. 5 is a perspective view of a door frame with a plurality of fastening strips extending therefrom and the plurality of fastening strips attached to a plurality of wall foam blocks of a foam and concrete building system in accordance with the present invention.
Figure 6:
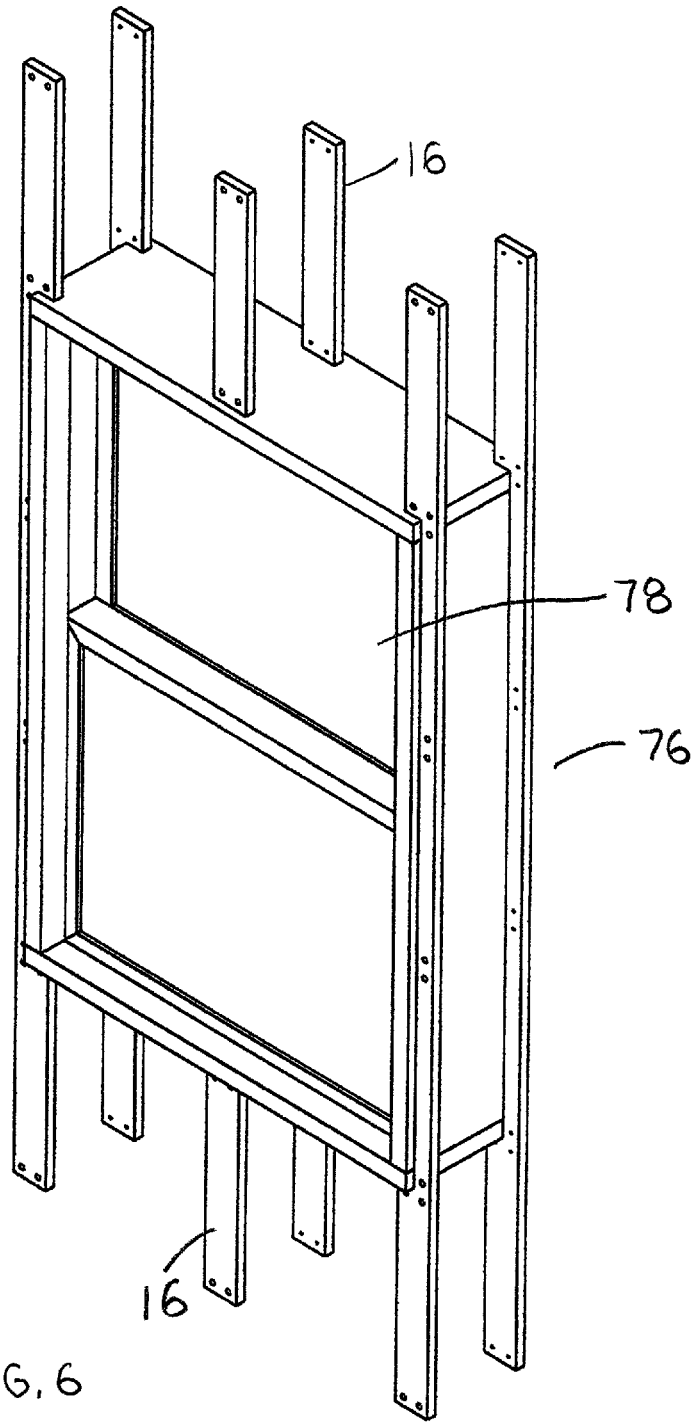
FIG. 6 is a perspective view of a window frame with a plurality of fastening strips extending therefrom of a foam and concrete building system in accordance with the present invention.

Each fastening strip 16 includes a plurality of holes 72 formed at heights that correspond to a height of the plurality of wall foam blocks 10 and the plurality of corner foam blocks 12. With reference to FIGS. 3 and 7, a plurality of holes are preferably formed through the plurality of wall and corner foam blocks 10, 12 to receive the plurality of fasteners 18 inserted through the plurality of holes 72 in the fastening strip 16. With reference to FIG. 6, a window frame 76 containing a window 78 also includes the plurality of fastening strips 16 extending from a top, bottom and opposing sides of the window frame 76, the plurality of fastening strips 16 are sized and positioned to receive the plurality of wall foam blocks 10. With reference to FIGS. 4-5, a door frame 80 containing a door 82 also includes the plurality of fastening strips 16 extending from a top and opposing sides of the door frame 80, the plurality of fastening strips 16 are sized to receive the plurality of wall foam blocks 10. With reference to FIG. 5, a half wall foam block 11 preferably includes a front block 21, a middle spacer 25 and a rear block 23. With reference to FIG. 9, when the plurality of wall and corner foam blocks 10-12; window frames 76 and door frame(s) 80 are assembled to each other with the plurality of fastening strips 16 and fasteners 18, concrete 14 is poured into vertical cavities in the plurality of wall and corner form blocks 10-12. With reference to FIG. 8, the poured concrete 14 forms a grid work structure inside the plurality of middle cavities 32, 64, end cavities 34, 60, 66, top cavities 36, 68, bottom cavities 38, 70 and corner cavities 62 in the plurality of wall and corner foam blocks 10-12.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An assembly of foam blocks capable of receiving poured concrete, comprising:

a plurality of wall foam blocks, each one of said plurality of wall foam blocks including a front plate, a rear plate and at least one middle spacer comprising foam and is located between said front and rear plates, a middle slot is formed in an outside surface of at least one of said front plate and said rear plate, an end slot is formed in an outside surface of each end of at least one of said front plate and said rear plate;

a plurality of fastening strips, each one of said plurality of fastening strips including a plurality of holes formed at heights that correspond to a height of said plurality of wall foam blocks, one of said plurality of wall strips is retained in said middle slot of one of said plurality wall foam blocks and said end slot of a vertically adjacent one of said plurality of wall foam blocks; and a plurality of fasteners for insertion through said plurality of holes and said plurality of wall foam blocks to orient said plurality of foam blocks into a vertical wall.

2. The assembly of foam blocks capable of receiving poured concrete of claim 1 wherein:

said plurality of wall foam blocks and a plurality of corner foam blocks are molded as a single unit.

3. The assembly of foam blocks capable of receiving poured concrete of claim 1, further comprising:

a window frame including a window and said plurality of fastening strips comprising strips extending from opposing sides and at least one of a top and a bottom of the window frame.

4. The assembly of foam blocks capable of receiving poured concrete of claim 1, further comprising:

a door frame including a door and said plurality of fastening strips comprising strips extending from opposing sides and a top of the door frame.

5. A foam block and poured concrete wall system, comprising:

a plurality of wall foam blocks, each one of said plurality of wall foam blocks including a front plate, a rear plate and at least one middle spacer comprising foam and is located between said front and rear plates, said at least one middle spacer is oriented between said front and rear plates to form at least one horizontal cavity and at least one vertical cavity, a middle slot is formed in an outside surface of at least one of said front plate and said rear plate, an end slot is formed in an outside surface of each end of at least one of said front plate and said rear plate;

a plurality of fastening strips, each one of said plurality of fastening strips including a plurality of holes formed at heights that correspond to a height of said plurality of wall foam blocks, one of said plurality of wall strips is retained in said middle slot of one of said plurality wall foam blocks and said end slot of a vertically adjacent one of said plurality of wall foam blocks;

a plurality of fasteners for insertion through said plurality of holes and said plurality of wall foam blocks to orient said plurality of foam blocks into a vertical wall; and a quantity of concrete is poured into said at least one vertical cavity, wherein said quantity of concrete flows into said at least one horizontal cavity.

6. The foam block and poured concrete wall system of claim 5 wherein:

at least three slots are formed in an outside surface of a plurality of corner foam blocks to receive at least three of said plurality of fastening strips.

7. The foam block and poured concrete wall system of claim 5 wherein:

said plurality of wall foam blocks and a plurality of corner foam blocks are molded as a single unit.

8. The foam block and poured concrete wall system of claim 5 wherein:

a window frame including a window and said plurality of fastening strips comprising strips extending from opposing sides and at least one of a top and a bottom of the window frame.

9. The foam block and poured concrete wall system of claim 5 wherein:

a door frame including a door and said plurality of fastening strips comprising strips extending from opposing sides and a top of the door frame.

10. A foam block and poured concrete wall system, comprising:

a plurality of wall foam blocks, each one of said plurality of wall foam blocks including a front plate, a rear plate and at least one middle spacer comprising foam and is; located between said front and rear plates, said at least one middle spacer is oriented between said front and rear plates to form at least one horizontal cavity and at least one vertical cavity, at least one slot is formed in an outside surface of at least one of said front plate and said rear plate;

a door frame having a groove formed on opposing sides thereof, a plurality of fastening strips extending from said opposing sides, each one of said plurality of fastening strips including a plurality of holes formed at heights that correspond to a height of said plurality of wall foam blocks, some of said plurality of wall foam blocks are positioned around said door frame such that said plurality of fastening strips are received within respective slots of said some of said wall foam blocks;

a plurality of fasteners for insertion through said plurality of holes; and a quantity of concrete is poured into at least one of said at least one vertical cavity and said at least one horizontal cavity, said plurality of foam blocks, said door frame, said plurality of fastening strips, said plurality of fasteners and said quantity of concrete form said foam block and poured concrete wall system, some of said quantity of concrete flows in said groove in said opposite sides of said door frame which aligns with respective vertical cavities of respective wall foam blocks.

11. The foam block and poured concrete wall system of claim 10 wherein:

at least two slots are formed in an outside surface of said plurality of wall and a plurality of corner foam blocks to receive at least two of said plurality of fastening strips.

12. The foam block and poured concrete wall system of claim 10 wherein:

at least three slots are formed in an outside surface of a plurality of corner foam blocks to receive at least three of said plurality of fastening strips.

13. The foam block and poured concrete wall system of claim 10 wherein:

said plurality of wall foam blocks and a plurality of corner foam blocks are molded as a single unit.

14. The assembly of foam blocks capable of receiving poured concrete of claim 13, further comprising:

said plurality of corner foam blocks each including an inner angle plate, at least two corner middle spacers and an outer angle plate, said at two corner middle spacers are located between said inner and outer angle plates.

15. The foam block and poured concrete wall system of claim 10 wherein:

a window frame including a window and said plurality of fastening strips comprising strips extending from opposing sides and at least one of a top and a bottom of the window frame.

* * * * *